United States Patent [19]

Kosek

[11] Patent Number: 4,704,668

[45] Date of Patent: Nov. 3, 1987

[54] SLEEVE TYPE LAMP STABILIZER

[75] Inventor: Robert E. Kosek, Winsted, Minn.

[73] Assignee: Sterner Lighting Systems Incorporated, Winsted, Minn.

[21] Appl. No.: 913,731

[22] Filed: Sep. 30, 1986

[51] Int. Cl.[4] ..... F21V 15/04

[52] U.S. Cl. ..... 362/390; 362/378; 362/389; 362/448; 362/457

[58] Field of Search ..... 362/389, 390, 376, 378, 362/448, 457, 253, 377; 313/318, 51; 339/144 T

[56] References Cited

U.S. PATENT DOCUMENTS

| | | | |
|---|---|---|---|
| 3,670,160 | 6/1972 | Flowers et al. | 362/378 |
| 3,801,815 | 4/1974 | Docimo | 362/364 |
| 4,231,081 | 10/1980 | Borruso | 362/390 |
| 4,432,046 | 2/1984 | Palsson | 362/378 |
| 4,513,359 | 4/1985 | Nielson | 362/389 |

FOREIGN PATENT DOCUMENTS

| | | | |
|---|---|---|---|
| 205660 | 10/1923 | United Kingdom | 362/390 |
| 675267 | 7/1979 | U.S.S.R. | 362/390 |

*Primary Examiner*—James C. Yeung
*Attorney, Agent, or Firm*—Kinney & Lange

[57] ABSTRACT

A sleeve type lamp stabilizer that is made so that it will fit over a lamp socket, to be rigidly held in place with respect to the socket. The stabilizer can be clamped to the socket or rigidly connected to the lamp housing which mounts the socket. The sleeve type stabilizer has pads that support the lamp at the lamp neck. The need for support results from the common practice to provide a small amount of clearance between the lamp socket and the mating base of the lamp to insure that the lamp will not corrode in place or otherwise become stuck in its socket when it is time to replace the lamp with present large lamps. This slight amount of play in the socket translates into a large amount of movement at the opposite end of the lamp and thus the independent support stabilizes the lamp, and prevents mechanical vibrations from prematurely causing lamp failure.

15 Claims, 10 Drawing Figures

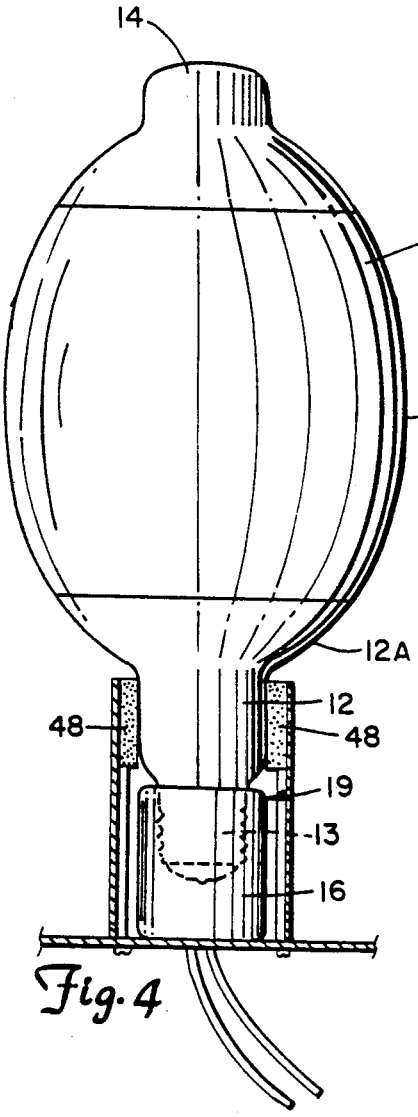
Fig. 4
Fig. 5
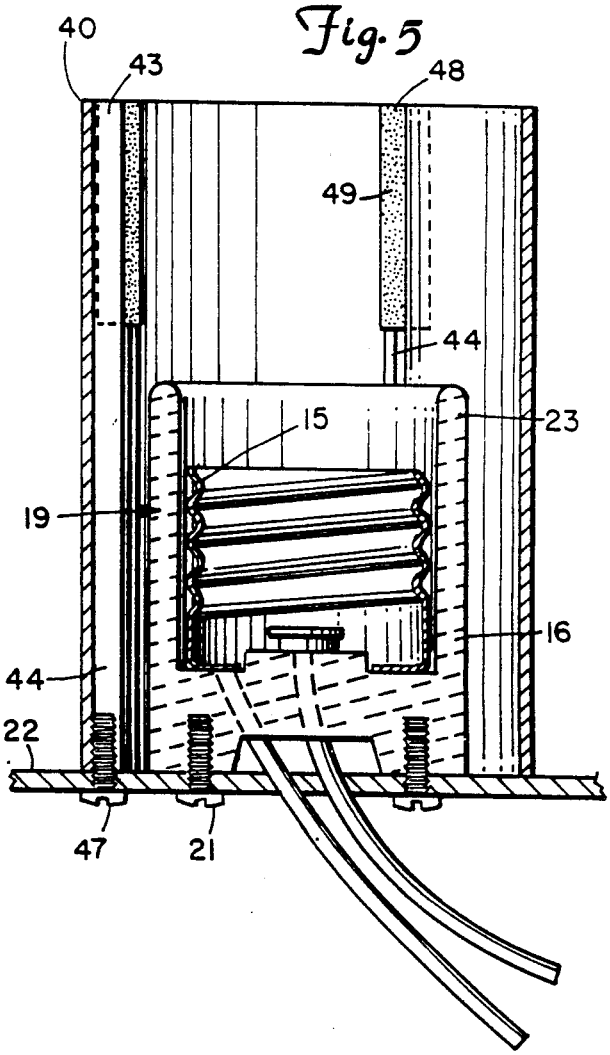

SLEEVE TYPE LAMP STABILIZER

BACKGROUND OF THE INVENTION

1. Field of the Invention

The present invention relates to stabilizers for lamps used in the lighting industry.

2. Description of the prior Art

The problem of vibrations of lamps (sometimes called light bulbs) has been recognized, and stabilizers that are independently mounted to support the outer end of a lamp are known. The presently made lamps have glass envelopes extending from a generally cylindrical neck that has a sufficient length to clear the socket. For example, U.S. Pat. No. 4,513,359, issued to the same assignee as the assignee of this application shows a lamp stabilizer that is mounted onto a housing at an outboard end of the lamp and supports such lamp. However, it is desirable to hold the lamps adjacent the base end, because supporting at the outboard end requires that there be a housing that encloses the outboard end and that the housing be accurately made so the outboard stabilizer properly locates the lamp relative to the reflector used.

Supports for lamps have also been used in connection with or adjacent to the base of the lamp, and for example U.S. Pat. No. 4,173,037 shows a lamp support device that comprises a type of a ring that engages the underside of the envelope of a lamp, and which is supported on adjustable brackets. However, this support does not provide a tube that is rigidly supported with respect to the lamp socket, and does require individual adjustment devices which comprise sliding brackets.

U.S. Pat. No. 4,232,360 shows a lamp construction which has an outer member that supports the lamp near the base but does not provide any substantial resistance to vibration. It comprises a transparent sleeve that goes around the lamp body and provides better heat conductance to reduce the damaging heat effects of the lamp.

U.S. Pat. No. 3,694,649 shows a type of a ring mounted on adjustable brackets for supporting a lamp, and is similar to the device shown in U.S. Pat. No. 4,173,037. The device of U.S. Pat. No. 3,694,649 has two types of open necked members that form a loop when used together, but again the support depends on individual adjustment and a number of separate pieces for operation.

U.S. Pat. No. 675,398 shows a sleeve type device that forms a weather guard. It is made out of brass and clamps in place, to guard the lamp. A sleeve type shield for an electronic tube is shown in U.S. Pat. No. 2,911,458, and merely provides a shield rather than any effective support for a tube or lamp.

U.S. Pat. No. 2,688,073 shows a holder for flood lamps wherein an outer housing provides a support for the flood lamp directly, with a ring engaging the back surface of the lamp. The ring does not engage or grip the lamp adjacent the cylindrical neck portion, and the support actually forms part of the lamp housing.

U.S. Pat. No. 2,491,170 shows a device supporting a lamp through three resilient fingers.

U.S. Pat. No. 4,419,716 shows a lamp housing that has cooling fins on it, but does not have a stabilizing support for the lamp itself.

U.S. Pat. No. 1,364,860 shows a cylindrical clamp that clamps around the neck of a tube for anti vibration purposes, and U.S. Pat. No. 1,151,219 shows a wire member that extends outwardly and engages the outer end of the lamp for supporting it.

A shock absorbing socket is shown in U.S. Pat. No. 1,626,108 which has a ring that actually clamps around the socket itself rather than around the lamp, but permits a spring to absorb some vibrations that may be damaging to the lamp.

Additional prior art of general interest include U.S. Pat. Nos. 805,558 and 4,491,170.

SUMMARY OF THE INVENTION

The present invention relates to tubular or sleeve type lamp supports that are made to surround the lamp socket and which are rigidly supported with respect to the socket. The stabilizer extends from the socket to directly engage the neck of a lamp that is in the socket and provide support independently of the tightness with which the lamp is screwed into the socket.

High intensity discharge lamps, such as mercury vapor, metal halide and sodium lamps are now being made in sizes up to 2,000 watts or more. Large lamps such as this have main envelopes that are very large in size, and somewhat in proportion to wattage. The large envelopes have a transition portion to a cylindrical neck on which the electrical connector screw shell or bayonet base is mounted. On single ended lamps which use screw shell or bayonet type sockets, it is necessary to allow a small amount of clearance between the lamp socket and the mating base of the lamp so as to insure that the lamp will not be corroded in place or otherwise stuck in the socket when it is time to replace the lamp.

The lamps are long, so any slight amount of play in the socket is translated into large play at the opposite end of the lamp. Lamp lengths can be up to 20 inches. The vibration present in many of the installations such as in city street lights or factory ceiling lights, cause premature failure if the lamp is permitted to vibrate and move because of looseness. These lamps are quite expensive, and can be economically operated only when they run for maximum design hours of life.

The lighting fixtures that use lamps being made today also have reflectors that are precisely positioned for maximum light output, and small changes in the center line of the lamp can cause greatly reduced performance. This also indicates that keeping the lamp rigid, properly positioned, and free from wobble is important.

The present invention provides a lamp stabilizer that is mounted on the inboard or socket end of the lamp and attaches to a support that is fixed relative to the socket itself, and engages the cylindrical lamp neck at selected locations around its periphery to rigidly hold the lamp relative to the socket even when the base of the lamp is slightly loose.

Two forms of the invention are shown, one wherein the tubular or sleeve support is clamped directly to the outer rigid insulator portion of the socket, and which has fingers that support the neck of the lamp around its periphery at at least three different points. A second form of the invention has a sleeve type stabilizer supported onto a housing wall on which the socket itself is also held securely. The neck engaging fingers or pads are biased to engage the socket neck firmly, either by way of natural resilience of inserts that are placed between the stabilizer and the lamp neck, or by having the fingers formed on the sleeve to provide this bias force.

Additionally, the sleeve can be extruded and have cooling fins thereon to help dissipate heat from the lamps. The stabilizer sleeves used also can be decorative to add to the aesthetic appeal of the lamp itself.

The lamp is gripped with insulating pads, and is not directly contacted by metal. The insulation can be accomplished by utilizing high temperature materials that are resilient or at least provide a force that bears against the lamp neck to stabilize it and hold it securely against wobbling.

BRIEF DESCRIPTION OF THE DRAWINGS

FIG. 4 is a side elevational view of a lamp and socket showing a stabilizer made according to a second form of the present invention installed around the socket;

FIG. 5 is an enlarged sectional view through the socket and stabilizer of FIG. 4;

DETAILED DESCRIPTION OF THE PREFERRED EMBODIMENTS

Figure 1:
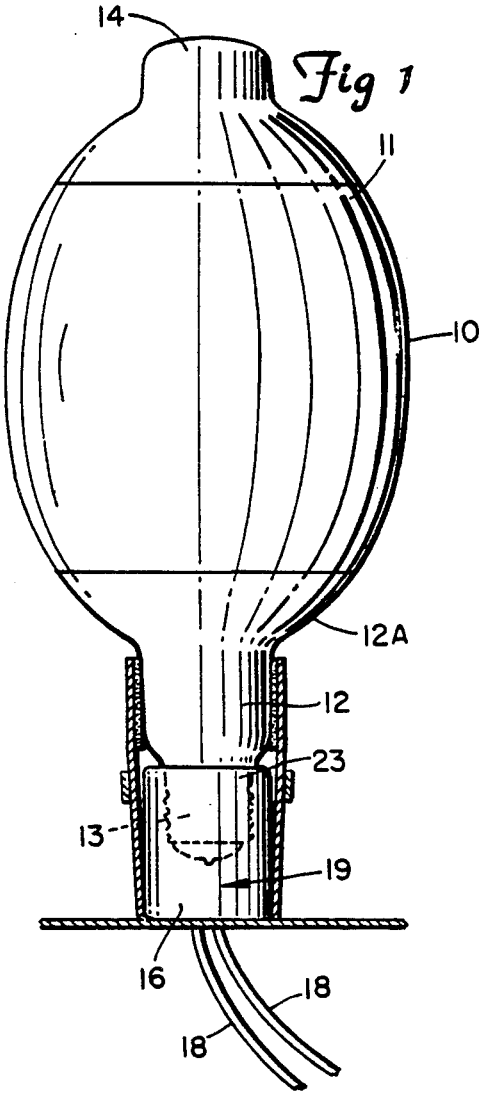
FIG. 1 is a side elevational view of a typical lamp and socket having a stabilizer made according to the present invention installed thereon.
Figure 3:
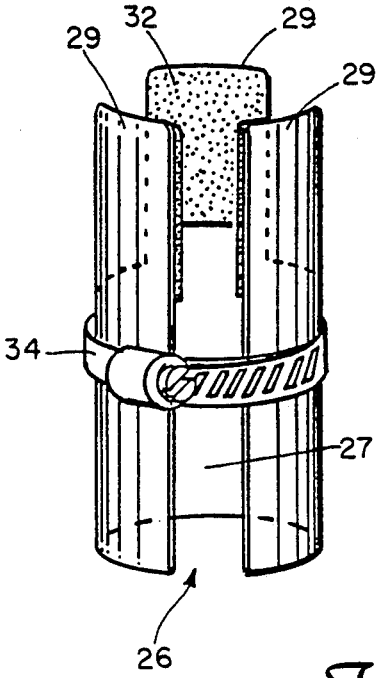
FIG. 3 is a perspective view of a modified form of the present invention shown in FIG. 1.
Figure 2:
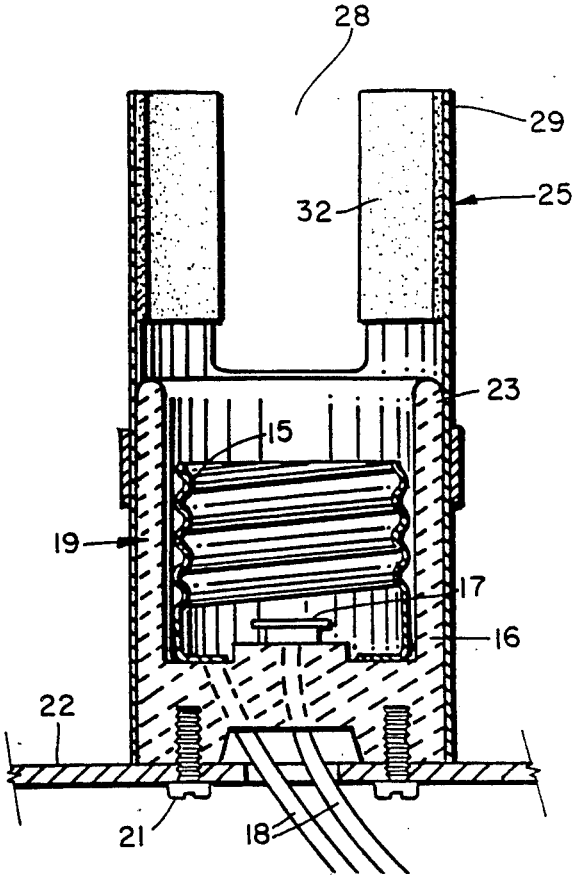
FIG. 2 is an enlarged sectional view of the socket and stabilizer shown in FIG. 1.
Figure 6:
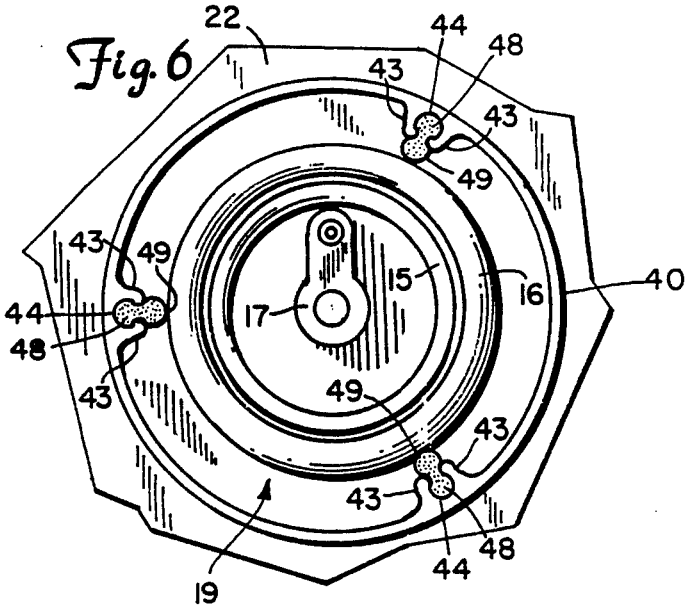
FIG. 6 is a top plan view of the device of FIG. 5.

In FIG. 1, a typical lamp is indicated at 10. The term "lamp" means essentially the "bulb" enclosure, and as shown, the lamp may be a high intensity discharge lamp such as mercury vapor, metal halide or sodium lamps. The lamp 10 has a large diameter outer glass envelope 11, a cylindrical neck 12, a metal electrical connector screw base indicated at 13 in dotted lines, and an outer end 14. The outer envelope is joined to the neck 12 through a transition section 12A. As shown, the screw base 13 is threaded into a threaded connector collar 15 (see FIG. 2) that is supported in an outer, rigid insulator socket 16, and the screw base and the center contact 17 are connected through suitable wires 18 to an electric power source. The collar 15 and insulator 16 forms a socket assembly 19.

The insulator socket 16 in the form of the invention shown is rigidly attached with suitable screws 21 to a lamp housing or support 22. This can comprise a reflector, a base frame, or any other type of support that is used for supporting the lamp 10 in its usable position.

The insulator socket 16 is generally made of porcelain, and quite rigid, and has an upwardly extending neck 23 that surrounds the screw collar 15 and extends upwardly therefrom. As was explained, when the lamp 10 is threaded in, the screw base 13 is left slightly loose in collar 15 to avoid corrosion and the like from locking the screw base in place. Of course the lamp 10 has to be sufficiently tight so that electrical contacts are made, but with slight looseness, the outer end 14 is able to move or wobble back and forth even with very little looseness between the screw base 13 and the threaded connector collar 15.

A lamp stabilizer sleeve 25 made according to the present invention, as shown, is generally tubular in form, and is made into a generally cylindrical shape having a split opening 26, forming a substantially continuous base wall portion 27 that forms a substantially annular band except for the split 26. The upper end of the stabilizer sleeve 25 is provided with deep notches 28 to separate out three fingers 29 that are equally spaced around the central axis of the lamp, and which are resilient and can be bent inwardly toward the neck 12 when the stabilizer sleeve 25 is in place as shown in FIG. 1. Each of the interior surfaces of the fingers 29 is provided with an insulating material pad 32 which is high temperature resistant material such as teflon, silicone rubber, ceramic felt or other similar materials. Small squares of silicone rubber or ceramic felt on the order of 0.062 inches thick could be glued to the inside of the fingers 29, or a length of heat shrinkable teflon tubing could be slid down on each of the fingers and then shrunk into place to provide the insulating layers or pads 32.

Clamp means, indicated at 34, which as shown comprises a screw tightenable hose clamp, forms a continuous band that is used for clamping the lower portion 27 of the sleeve around the insulator portion 16 of the socket assembly 19 tightly, to rigidly hold the lamp stabilizer with respect to the base of the lamp to clamp the pads 32 and the fingers 29 against the cylindrical neck 12 of the lamp 10 to hold it securely.

It can be seen that the sleeve type stabilizer provides a balanced load against the neck 12 of the lamp 10, securely holds it, and will retain it in a fixed position regardless of whether or not the screw threads on the neck 13 and the threaded connector collar 15 are tight. The lamp can be removed from collar 15 and replaced without removing the stabilizer.

A modified form of the invention is shown in FIGS. 5–10, and in this form of the invention, the lamp 10 has a neck 12, an outer envelope 11, a threaded base member 13, and an outer end 14 as previously explained. A lamp socket assembly 19 is constructed in the same manner having a metal threaded collar 15, the insulator socket 16, a socket upper end 23, the center contact 17 and the wires 18 for carrying power. The base or housing 22 is the same as in the previous form of the invention, and the screws 21 hold the insulator socket 16 and thus socket assembly 19 rigidly fixed with respect to the base. In this form of the invention, a lamp stabilizer sleeve 40 is an extruded tubular sleeve member, such as extruded aluminum or the like, that forms a sleeve that is annular, and has extruded longitudinally extending bosses or ribs 43 equally spaced around the periphery of the sleeve 40, and each of these bosses or ribs has a groove 44 defined therein. As shown, the lower ends of the grooves 44 are of size to receive self tapping screws 47 that are connected through the base 22 to securely hold the sleeve type stabilizer fixed to the base and thus fixed with respect to the socket assembly 19.

In the upper portions of the stabilizer 40 there are pads 48 that are slid into the grooves 44 and have outer edge portions indicated at 49 that engage the cylindrical neck 12 of the lamp 10 to provide a resilient or biasing clamping force to hold the neck 12 securely and stabilize the lamp 10 even if the screw base 13 is slightly loose in collar 15.

In this form of the invention, the stabilizer again is a sleeve type stabilizer that is fixed with respect to the socket assembly 19, through the connection of the base 22. The sleeve is closely surrounding the socket and is rigid with respect thereto. The resilient insulating pads 48 provide the biasing force in this form of the invention. The pads 48 are positioned in the grooves 44 of the ribs 43. Because the grooves 44 can be made of size to receive self tapping screws, the cost of mounting the stabilizer sleeve is reduced substantially as well.

Figure 7:
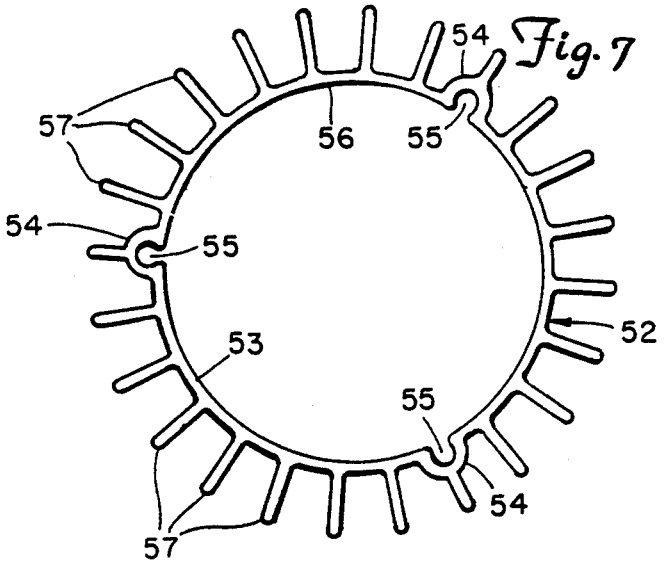
FIG. 7 is a top plan view of a modified form of the device shown in FIG. 5.

FIG. 7 shows a modified form of the device shown in FIG. 5, and comprises a sleeve type lamp stabilizer 52 which is shown in end view, and which comprises a sleeve 53, with external ribs or boss members 54 spaced equally around the periphery thereof. The boss members 54 are formed to the exterior of the sleeve 53 and have grooves 55 therein that are of size to hold insulator support and clamping pads such as those shown at 48.

In addition, the extruded sleeve 53 for the stabilizer 52 has a plurality of radial fins 57 that extend from the outer periphery thereof and provide cooling for the lamp and socket assembly. These fins can be of various configurations, but, as shown, when the extrusion is made they are parallel to the central axis of the stabilizer sleeve 53.

Figure 8:
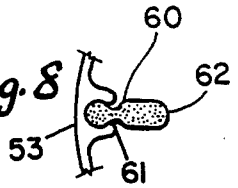
FIGS. 8, 9 and 10 are fragmentary sectional views showing typical insulator pads that are used with the device shown in FIGS. 6 and 7 for engaging the neck of a lamp for stabilizing it.
Figure 9:
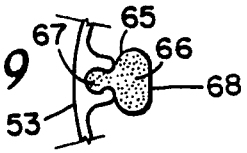
Figure 10:
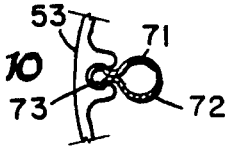

FIGS. 8, 9 and 10 show sections of the stabilizer sleeve 53 with different configuration insulator and gripping pads. In FIG. 8, a gripping pad 60 is shown as fitting inside a groove 55, and has a reduced cross section portion 61 and an outer end portion 62 that provides for some movement of the outer end portion 62 to permit the lamp 10 to be screwed in and out while still providing a biasing force.

FIG. 9 shows an insulator pad 65 that has an enlarged outer end 66, and a smaller end 67 that slides within a groove 55. This also permits the lamp 10 to be screwed in while the stabilizer is installed, but provides a wider surface area at the face 68 to engage the neck 12 of the lamp.

FIG. 10 shows a tubular insulator member 71 that has a larger outer end 72 that will engage the lamp neck 12, and a smaller member 73 that slides into a groove 55 for coupling to the stabilizer. The member 71 can compress as the lamp 10 is screwed into place, and it will bear against the neck 12 of the lamp 10 with sufficient force to hold it rigidly.

In each of the forms of the invention, the tubular or sleeve type stabilizer surrounds the insulator socket portion 16 of the socket assembly, as well as the threaded collar 15 for the lamp 10, and is supported rigidly with respect to the socket. As stated another way, the stabilizer sleeve is supported securely and rigidly with respect to the socket that supports the lamp. The lamp socket could be either a screw collar or a bayonet type socket. Lamp collar refers to the actual member that supports the lamp and provides electrical connections thereto.

Then, the sleeve stabilizer member rigidly extends upwardly to engage the neck of the lamp with somewhat compressible or resilient members that provide a biasing force that rigidly holds the lamp neck even when the lamp is not tightly threaded into the lamp socket.

Although the present invention has been described with reference to preferred embodiments, workers skilled in the art will recognize that changes may be made in form and detail without departing from the spirit and scope of the invention.

What is claimed is:

1. A sleeve type lamp stabilizer for use in connection with a lamp socket for receiving and electrically connecting to an elongated lamp having a lamp neck at one end, said lamp socket being supported relative to a base, said lamp stabilizer comprising:

a unitary rigid sleeve member surrounding such lamp socket and means for rigidly supporting the sleeve member with respect to a lamp socket adjacent a first end of the sleeve member;

a second end of said sleeve member extending outwardly beyond the outer end of a lamp socket with which it is used and having inwardly directed means thereon to securely engage the neck of a lamp in a socket with which the stabilizer is used in at least three annularly spaced locations, said means to engage the neck of the lamp comprising means for providing a biasing force to exert a sufficient force on the neck of such a lamp such that the neck of such lamp is rigidly supported from moving laterally relative to such lamp socket.

2. The apparatus as specified in claim 1 wherein said means providing a biasing force comprise heat resistant pads on the sleeve member at equally spaced locations around the sleeve member.

3. The apparatus as specified in claim 2 wherein said lamp stabilizer comprises a split tubular member, the lamp socket with which the stabilizer is used comprising a rigid insulator rigidly secured to the lamp socket, and means to clamp said tubular member onto such rigid insulator to rigidly support the tubular member with respect thereto.

4. The apparatus as specified in claim 3 wherein said second end of said tubular member comprises three fingers having inwardly facing pads that engage a neck portion of a lamp mounted in a socket with which the stabilizer is used.

5. The apparatus as specified in claim 1 wherein said inwardly directed means comprise inwardly facing and projecting compressible pads mounted on the sleeve.

6. The apparatus as specified in claim 5 wherein said sleeve member comprises an extruded sleeve member having wall portions forming longitudinally extending grooves, said compressible pads being mounted in said grooves adjacent a second end of said sleeve member, and the means to support said sleeve member comprising ends of said longitudinally extending grooves at the second end thereof being of size to receive screws extending through a base supporting a lamp socket with which the stabilizer is used.

7. The apparatus as specified in claim 6 wherein said extruded sleeve member has radially extending fins formed on the exterior thereof.

8. The apparatus as specified in claim 6 wherein said resilient members comprise resilient rib members slid into longitudinally extending grooves provided in said extruded sleeve member adjacent the second end of said extruded sleeve member.

9. In combination, a sleeve type lamp stabilizer and a lamp socket for receiving and electrically connecting to an elongated lamp having a cylindrical lamp neck at one end, which fits into the socket for electrical connection thereto said lamp socket being supported relative to a base, said lamp stabilizer comprising:

a sleeve member surrounding said lamp socket and being rigidly supported at a first end of the sleeve member with respect to said lamp socket;

a second end of said sleeve member extending outwardly beyond the outer end of said lamp socket and having inwardly directed bias means thereon to engage the lamp in a socket with which the stabilizer is used in at least three annularly spaced locations in the region of the lamp neck, said means to engage such lamp providing a biasing force to prevent the neck of such lamp from moving laterally relative to the socket and rigidly retaining such lamp relative to such socket independently of the fit between the lamp socket and the lamp neck.

10. The apparatus as specified in claim 9 wherein said bias means comprises heat resistant pads on the sleeve member at equally spaced locations around the sleeve member.

11. The apparatus as specified in claim 10 wherein said lamp stabilizer comprises a split tubular member, the lamp socket comprising a rigid insulator portion, and means to clamp said split tubular member onto such rigid insulator portion to rigidly support the tubular member with respect thereto.

12. The apparatus as specified in claim 10 wherein said sleeve member comprises an extruded sleeve member having wall portions forming longitudinally extending grooves, said pads being mounted in said grooves adjacent a second end of said sleeve member, and the means to support said sleeve member comprising screws threaded into said longitudinally extending grooves at the second end of the sleeve member, said screws fixing the sleeve relative to the base on which the lamp socket is mounted.

13. The apparatus of claim 12 wherein the wall portions comprise ribs along the tubular member in which the grooves are formed.

14. The apparatus of claim 12 wherein said base comprises a wall having a support surface surrounding the socket, said extruded sleeve member having an end surface resting on and being clamped to said support surface, said extruded sleeve being concentric with the lamp socket.

15. The apparatus of claim 14 and a plurality of radially extending fins on the exterior of said extruded sleeve.

* * * * *